United States Patent [19]

Zanavich

[11] 3,950,857

[45] Apr. 20, 1976

[54] LAYOUT TOOL

[76] Inventor: Joseph J. Zanavich, 69 Woodruff Ave., Watertown, Conn. 06795

[22] Filed: Jan. 27, 1975

[21] Appl. No.: 544,214

[52] U.S. Cl. ..... 33/174 G; 33/180 R; 33/DIG. 10

[51] Int. Cl.[2] ..... B27C 1/00

[58] Field of Search..... 33/DIG. 10, 180 R, 174 G, 33/189, 169 C, 169 R, 197

[56] References Cited

UNITED STATES PATENTS

| | | | |
|---|---|---|---|
| 2,349,567 | 5/1944 | Townsend, Jr. et al. | 33/189 |
| 3,823,754 | 7/1974 | Nix | 33/DIG. 10 |

*Primary Examiner*—Richard E. Aegerter
*Assistant Examiner*—Willis Little
*Attorney, Agent, or Firm*—Dallett Hoopes

[57] ABSTRACT

A layout tool for marking for cut out on the back of a panel or the like the outline of an electrical box. The tool comprises a bridge member having an outward boss and point and a layout bar having at one end an opening adapted to receive the boss, and on the opposite side of the opening, a second point. A blade is movable along the bar and may be set to the respective sides of the box when the opening of the bar receives the first point so that the setting may be transferred to the back of the panel as the point on the bar is made to coincide with an indentation made on the panel by the first point.

5 Claims, 8 Drawing Figures

LAYOUT TOOL

This invention relates to layout tools for use in marking for cut out the outline of an electrical box or the like on the sheet material such as panelling to be installed over the box so that the panelling will expose the mouth of the box to render access to the switch, receptacle, or other device in the box.

BACKGROUND OF THE INVENTION

1. Field of the Invention

The invention relates to devices useful for marking panel material and the like for subsequent cut out. Such marking under the invention is done with great exactness so that the finished panel product exactly fits over the box, exposing the mouth of the box as desired.

2. Description of the Prior Art

In the prior art, there have been patents such as U.S. Pat. No. 2,898,688 to Cottar, granted Aug. 11, 1959. This patent shows a plate having upstruck teeth and in use the plate is attached to the front of the electrical box with the teeth protruding outward so that the panel can be struck against the teeth, making indentations for cut out on the rear surface of the panel. Another device in the prior art is shown in U.S. Pat. No. 2,775,812 to Mohr. In this patent, tongues are provided for attachment to the opposite ends of an electrical box whereby the panel may be impacted against the tongues to cause the tongues to impale the panel. With the tongues thus impaling the panel, the protruding portions thereof may be used to support a template for marking the panel for cut out.

While the devices of the prior art have been practical to some extent, they have not offered a versatility for different shaped boxes and other devices so that the marking can accommodate to a wide range of boxes and other devices. Also, they have not offered the precision such as I provide in my present invention.

SUMMARY OF THE INVENTION

The present invention involves the provision of a bridge member adapted to be installed across the electrical box, the bridge being provided with a pointed element extending out from the center of it. A separate layout bar is provided, the bar having at one end a lateral opening and on the opposite side of said end a point aligned with the opening, the bar having adjustably mounted thereon a layout blade adapted to serve as a straight edge. In use, the bridge is installed on the box and the panel is placed in position and tapped against the point. The panel is then withdrawn from the box and the opening in the bar is placed over the point on the bridge. The blade is adjusted on the bar to coincide with a side of the box and the bar is then removed from the bridge and the point on the bar placed in the indentation on the panel to mark the corresponding side of the cut-out. The procedure involving the placement of the bar is repeated then for each side of the box.

In this manner, there is marked on the panel with great exactness, the outline of the box so that it can be subsequently cut out and the panel permanently installed over the box.

Other features and advantages of the invention will be apparent from the following specification, including the drawings, all of which disclose a non-limiting form of the invention. In the drawings.

DESCRIPTION OF THE PREFERRED EMBODIMENT

Figure 1:
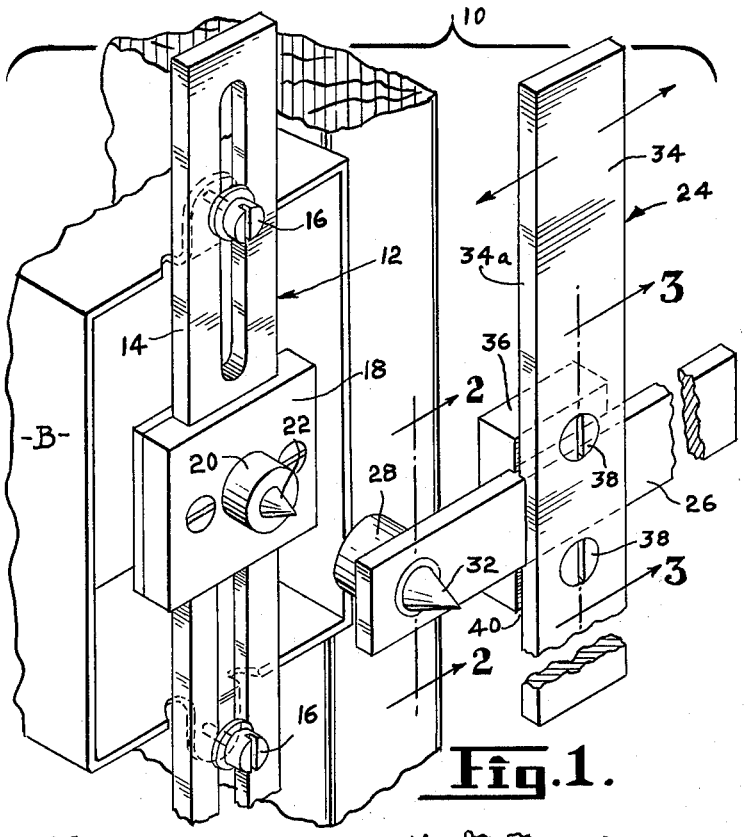
FIG. 1 is a perspective view showing the layout tool in use on an electrical box.

A device embodying the invention is shown in FIG. 1 and is generally designated 10. It comprises a bridge member 12 including a longitudinally slotted elongate element 14. As shown, the bridge member 12 may be attached to an electrical box B by fasteners 16 received through the slots in the element 14. Disposed centrally of the bridge 12 is a base 18 which presents a cylindrical boss 20 extending out forwardly therefrom. Centrally of the boss is a first point 22.

In installation on the box B, the position of the bridge is such that the point 22 is approximately in the center of the box B, this being possible by the accommodation of the engagement of the fasteners 16 in the slots, as shown.

Figure 2:
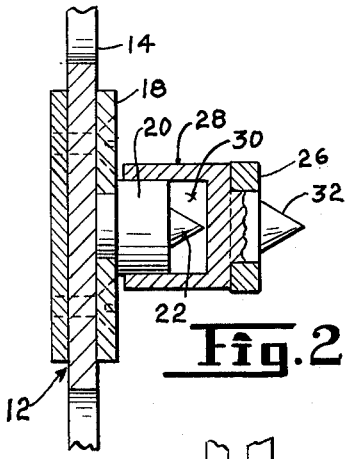
FIG. 2 is a fragmentary sectional view taken on the line 2—2 of FIG. 1.

The layout tool embodying the invention also includes a marking assembly 24 including an elongate layout bar 26. As shown best in FIG. 2, the bar is formed on one side with an enlargement 28 which is formed with a cylindrical opening 30. On the opposite side of the bar 26 and aligned with the center line of the opening 30 is the point 32.

Figure 3:
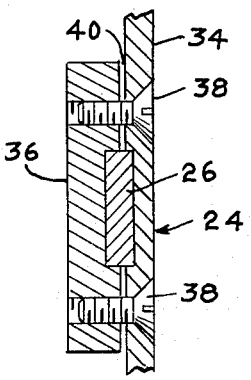
FIG. 3 is a fragmentary sectional view taken on the line 3—3 of FIG. 1.

Adjustably fixed along the bar 26 is the layout blade 34 which is provided with a clamping plate 36. As best shown in FIG. 3, the clamping plate 36 and the blade 34 are provided with opposing recesses adapted to receive the bar 26. Fastening means such as bolts 38 draw the blade 34 and clamping plate 36 together to sandwich the bar 26 forceably therebetween. It should be noted that the dimensions are such that there is a space 40 provided between the blade and clamping bar on either side of the layout bar 26 so that the force of the fastening elements 38 works against the bar. Preferably as shown, the recesses in the blade 34 and clamping plate 36 are such as to put the blade 34 in a perpendicular disposition with respect to the bar 26.

Having described the structure of the preferred embodiment, attention is now directed to FIGS. 4 through 8 showing the use thereof. In the first operation, the bridge 12 is securely fastened by the fasteners 16 of the electrical box B. As can be noted, the slots in the bridge 14 permit up and down movement of the bridge before tightening fasteners 16 to permit the centralizing of the point 22 with respect to the box B. Additionally, the fasteners on base 18 as shown may be loosened to raise or lower the base 18 with respect to bridge 12 and then tightened, to also effect such centralizing. It will be understood, however, that the centering of the point 22 with respect to box B is not absolutely necessary but may be a convenience. For instance, if the point is centered and the box B is square, only one setting of the blade 34 is necessary, as will be understood.

The panel P is then brought up and placed against its neighboring panel edge-to-edge and an impact force such as by the fist or non-marring tool of some sort, is impacted against the panel (see arrows) to drive the point 22 into the rear face of the panel. Thereafter, the panel is withdrawn from its position so that its rear face is exposed for further work.

Figure 5:
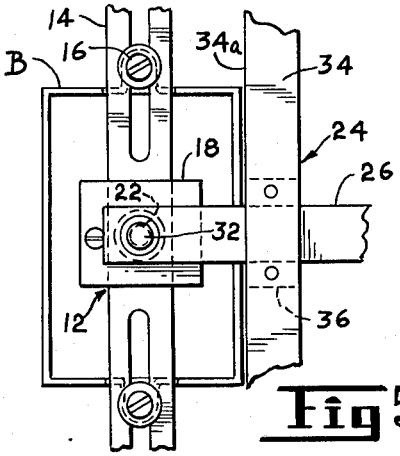
FIG. 5 is a reduced fragmentary view showing the blade of the device being set according to the position of on side of the electrical box involved.

Next, the layout assembly 24 is brought towards the box and the opening 30 is placed over the cylindrical boss 20 of the base 18 with the layout bar 26 extending to one side. The blade 34 is then slid along the bar 26 loosening the fasteners 38 if necessary, and then tightening them when an edge of the blade 34*a* is aligned with a side of the box B (FIG. 5).

Figure 6:
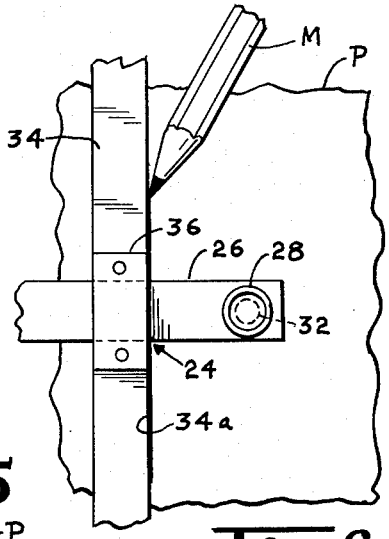
FIG. 6 is a view showing the marking of the panel in accordance with the setting of FIG. 5.

Thereafter, the layout assembly 24 is removed from the bridge and the point 32 is inserted in the indentation I made in the panel P by the point 22. The bar 26 is made to go out from the point 32 in a direction on the panel corresponding to the same direction that the side of the box involved has with respect to the point 22. A pencil, or other marker M, is then used to draw along the edge 34*a* (FIG. 6).

Figure 4:
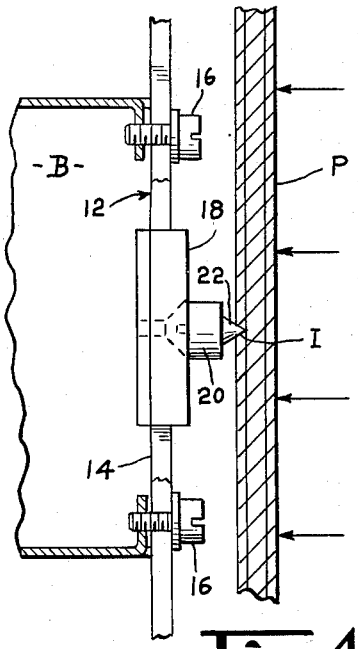
FIG. 4 is a sectional view showing a panel being struck against the point of the bridge.
Figure 7:
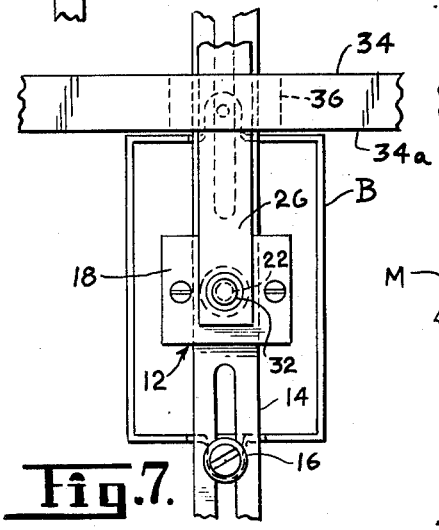
FIG. 7 is a reduced fragmentary view showing the blade of the device being set according to the position of an end of the electrical box involved.
Figure 8:
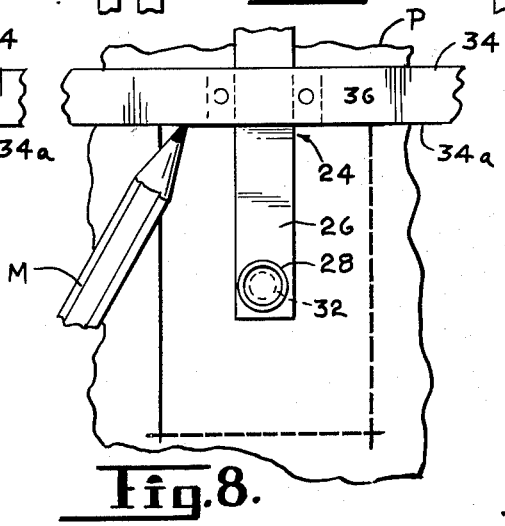
FIG. 8 is a view showing the marking of the panel in accordance with the setting of FIG. 7.

For marking the top end of the box on the panel P, the layout assembly 24 is returned to the bridge with the opening 30 receiving the boss 20 and the bar 26 extending upward therefrom. The blade 34 is then moved along the bar 26 unloosening the fasteners 38 as necessary, the blade 34 is then firmly fixed by tightening the fasteners 38 in a position where the edge 34*a* of the blade corresponds with the upper end of the box B (FIG. 7). The assembly 24 is then removed from the bridge 12 and moved to the rear face of the panel where the point 32 is moved into the indentation I on the panel caused by the point 22 (FIG. 4). Bar 26 is then made to go upward and the marker M is used to draw a ling (FIG. 8) along the edge 34*a*. Subsequently, the other two sides of the outline of the box are marked as in the two sides already described. The marks for the other two sides are shown in dotted line in FIG. 8.

Thus, there is marked with great accuracy, the outline of the box B on the back of the panel P so that when the panel is installed on the wall, the mouth of the box B will show through the hole cut along the lines.

It should be understood that variations of the device shown are possible within the scope of the invention. For instance, the blade 34 and the clamping plate 36 may be spring-biased together for facility of moving such parts along the bar 26 without the need for undoing the tightening fasteners 38. Similarly, various parts of the device may be made of plastic for economy. It should thus be clear that having described the invention in but one form, I do not have in mind limiting the invention to the embodiment shown. Indeed, the invention is of such scope as is defined in the following claim language:

I claim:

1. A layout tool for use in marking for cutout the outline of an electrical box and the like on sheet material such as panelling to be installed over the box, comprising in combination a bridge member and means for securing it across the mouth of the electrical box, the bridge member having an outwardly-facing circular boss terminating in an outwardly-facing first point means, and a layout bar having at one end on one lateral face opening means for swivelly and removably receiving the circular boss of the bridge member and having second point means on the opposite lateral face aligned with said opening means, the second point means being oriented to point in the same direction as the first point means when the opening means receives the circular boss, and a layout blade means adjustably disposed along the layout bar and disposed transversely with respect thereto whereby the first point means can be used to make an impression on the rear face of the panelling, and an outline of the box can be marked on the rear face of the panelling using the second point means in the impression with the blade means set on the bar distances corresponding to the distances from the boss to the respective sides of the box when the opening on the bar receives the boss.

2. A layout tool as claimed in claim 1 wherein the blade means is secured on the bar means by having a clamping plate secured to the blade and fastening means releaseably urging the blade and plate toward each other, the bar being disposed between the plate and blade.

3. A layout tool as claimed in claim 2 wherein the fastening means comprise a pair of spaced threaded elements, one on either side of the bar.

4. A layout tool as claimed in claim 1 wherein the circular boss is disposed on a block secured in the center of the bridge element.

5. A layout tool as claimed in claim 4 wherein the bridge member is formed with elongated slot means and the means for securing comprise threaded fasteners extending through the slot means and adapted to engage threaded openings on either side of the mouth of the electrical box to firmly hold the bridge in fixed position.

* * * * *